US011496845B1

(12) United States Patent
Lager et al.

(10) Patent No.: US 11,496,845 B1
(45) Date of Patent: Nov. 8, 2022

(54) HORIZONTAL ABUTMENT EXTENDER

(71) Applicant: Cochlear Limited, Macquarie University (AU)

(72) Inventors: Emelie Lager, Onsala (SE); Madeleine Gustavsson, Hällingsjö (SE); Henrik Fyrlund, Mölnlycke (SE)

(73) Assignee: Cochlear Limited, Macquarie University (AU)

( * ) Notice: Subject to any disclaimer, the term of this patent is extended or adjusted under 35 U.S.C. 154(b) by 707 days.

(21) Appl. No.: 16/400,722

(22) Filed: May 1, 2019

Related U.S. Application Data

(60) Provisional application No. 62/669,881, filed on May 10, 2018.

(51) Int. Cl.
*H04R 25/00* (2006.01)

(52) U.S. Cl.
CPC ..... *H04R 25/65* (2013.01); *H04R 2225/67* (2013.01)

(58) Field of Classification Search
CPC .... H04R 25/60; H04R 25/604; H04R 25/606; H04R 25/65; H04R 2225/67; H04R 2225/77
See application file for complete search history.

(56) References Cited

U.S. PATENT DOCUMENTS 3,030,455 A * 4/1962 Pearson ..... H04R 25/606 600/25
8,634,583 B2 1/2014 Bern
8,761,416 B2 6/2014 Hakansson
2013/0018218 A1 1/2013 Haller et al.
2013/0116497 A1* 5/2013 Vermeiren ..... H04R 25/606 381/326
2014/0121450 A1* 5/2014 Kasic ..... H04R 25/60 600/25
2014/0121452 A1* 5/2014 Kasic ..... H04M 1/24
2014/0179985 A1* 6/2014 Andersson ..... H04R 25/60 600/25
2016/0192092 A1* 6/2016 Westerkull ..... H04R 25/60 600/25
2018/0035225 A1* 2/2018 Inagaki ..... H04R 25/60 600/25

OTHER PUBLICATIONS

Nave, Carl R. "Audible Sound." Sensitivity of human ear. Georgia State University, Apr. 9, 2018. https://web.archive.org/web/20180409110221/http://hyperphysics.phy-astr.gsu.edu/hbase/Sound/earsens.html (Year: 2018).*

* cited by examiner

*Primary Examiner* — Thaddeus B Cox
*Assistant Examiner* — Marc D. Honrath
(74) *Attorney, Agent, or Firm* — Knobbe, Martens, Olson & Bear, LLP

(57) ABSTRACT

An apparatus is provided that includes an elongate body, a first connector, and a second connector. The first connector has a first axis and is configured to be repeatedly attached to and detached from a percutaneous implant of a bone conduction acoustic prosthesis system. The second connector has a second axis and is configured to be repeatedly attached to and detached from a component of the acoustic prosthesis system, the component external to the recipient. The first axis and the second axis are offset from one another along a first direction.

27 Claims, 12 Drawing Sheets

HORIZONTAL ABUTMENT EXTENDER

BACKGROUND

Field

The present application relates generally to bone conduction auditory prostheses, and more specifically systems and methods for facilitating repositioning of external actuators of such auditory prostheses.

Description of the Related Art

Hearing loss, which may be due to many different causes, is generally of two types, conductive and/or sensorineural. Conductive hearing loss occurs when the normal mechanical pathways of the outer and/or middle ear are impeded, for example, by damage to the ossicular chain or ear canal. Sensorineural hearing loss occurs when there is damage to the inner ear, or to the nerve pathways from the inner ear to the brain.

Individuals who suffer from conductive hearing loss typically have some form of residual hearing because the hair cells in the cochlea are undamaged. As a result, individuals suffering from conductive hearing loss might receive an auditory prosthesis that generates mechanical motion of the cochlea fluid instead of a hearing aid based on the type of conductive loss, amount of hearing loss and customer preference. Such prostheses include, for example, bone conduction devices and direct acoustic stimulators.

Bone conduction devices mechanically transmit sound information to a recipient's cochlea by transferring vibrations to a person's skull, enabling the hearing prosthesis to be effective regardless of whether there is disease or damage in the middle ear. Traditionally, bone conduction devices transfer vibrations from an external actuator (e.g., vibrator) to the skull through a percutaneous bone conduction implant that penetrates the skin and is physically attached to both the actuator and the skull. Typically, the external actuator is connected to the percutaneous bone conduction implant located behind the outer ear facilitating the efficient transfer of sound via the skull to the cochlea. The bone conduction implant connecting the actuator to the skull generally comprises two components: a bone attachment piece (e.g., bone fixture/fixture) that is attached or implanted directly to the skull, and a skin-penetrating piece attached to the bone attachment piece, commonly referred to as an abutment.

SUMMARY

In one aspect disclosed herein, an apparatus is provided. The apparatus comprises an elongate body, a first connector, and a second connector. The first connector has a first axis and is configured to be repeatedly attached to and detached from a percutaneous implant of a bone conduction acoustic prosthesis system. The second connector has a second axis and is configured to be repeatedly attached to and detached from a component of the acoustic prosthesis system, the component external to the recipient. The first axis and the second axis are offset from one another along a first direction.

In another aspect disclosed herein, an apparatus is provided. The apparatus comprises an extender configured to be reversibly attached to an abutment of a bone conduction auditory prosthesis. The abutment is affixed to a fixture implanted on a skull bone of a recipient. The extender is further configured to be reversibly attached to a component of the auditory prosthesis, the component external to the recipient. The extender is configured to transmit acoustic, vibrations generated by the component to the abutment along a direction substantially parallel to the skull bone proximal to the fixture.

In another aspect disclosed herein, a method is provided. The method comprises attaching a first end portion of an elongate body to a bone conduction device implanted on a recipient. The elongate body extends in a first direction along a portion of skin behind an outer ear of the recipient. The method further comprises attaching a second end portion of the elongate body to an external actuator. The actuator is offset from the bone conduction device along the first direction.

BRIEF DESCRIPTION OF THE DRAWINGS

Embodiments are described herein in conjunction with the accompanying drawings, in which.

DETAILED DESCRIPTION

Under certain circumstances, a recipient of a bone conduction auditory prosthesis system is unable to wear both a rigid head covering (e.g., a helmet) and an external component (e.g., sound processor) of the bone conduction auditory prosthesis system. For example, for a percutaneous bone conduction auditory prosthesis system, the helmet may cover and/or be in close proximity to the percutaneous implant, leaving insufficient room to attach the component directly to the implant. Certain embodiments described herein provide a system and method for offsetting the position of the external component away from its standard position (e.g., directly coupled to the percutaneous implant)

while retaining the ability to transmit acoustic vibrations from the component to the implant. An extender having an elongate, rigid body is provided which has a first connector configured to be connected to the external component and a second connector spaced from the first connector and configured to be connected to the implant. Thus, certain such embodiments advantageously allow the recipient to benefit from simultaneously wearing the helmet for safety and using the auditory prosthesis for hearing.

Figure 1A:
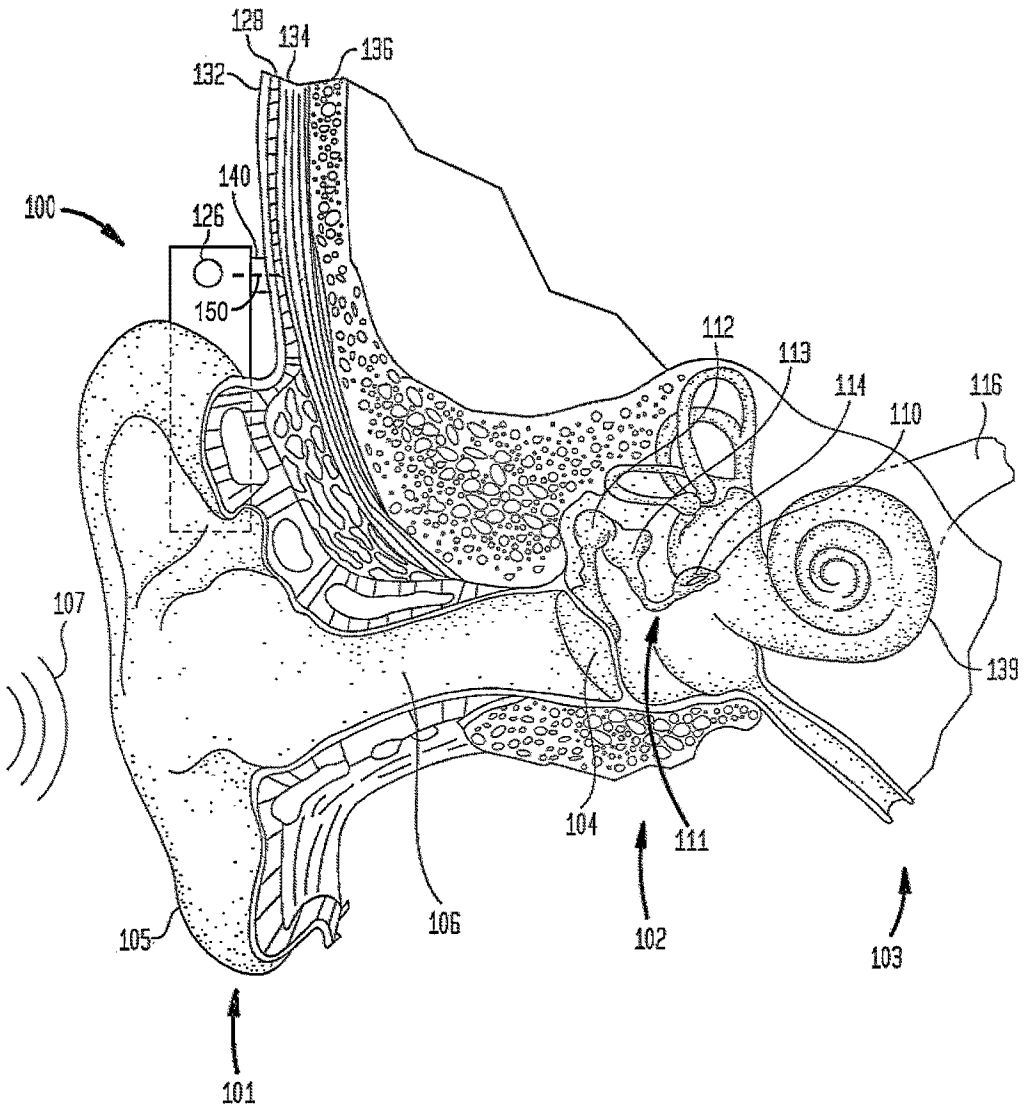
FIG. 1A is a perspective view of an example percutaneous bone conduction auditory prosthesis implanted in a recipient in accordance with certain embodiments described herein.
Figure 1B:
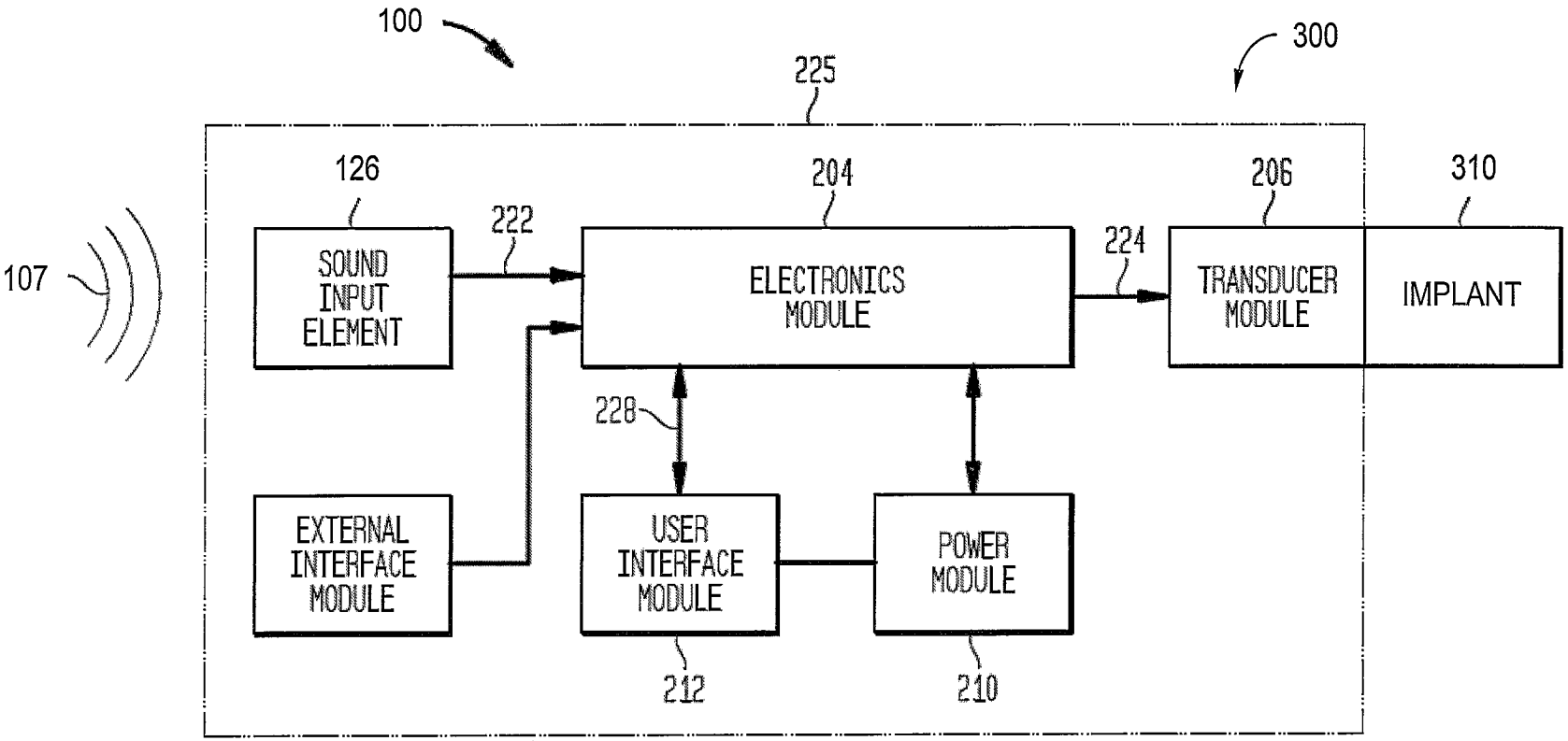
FIG. 1B is a functional block diagram of an example auditory prosthesis in accordance with certain embodiments described herein.
Figure 1C:
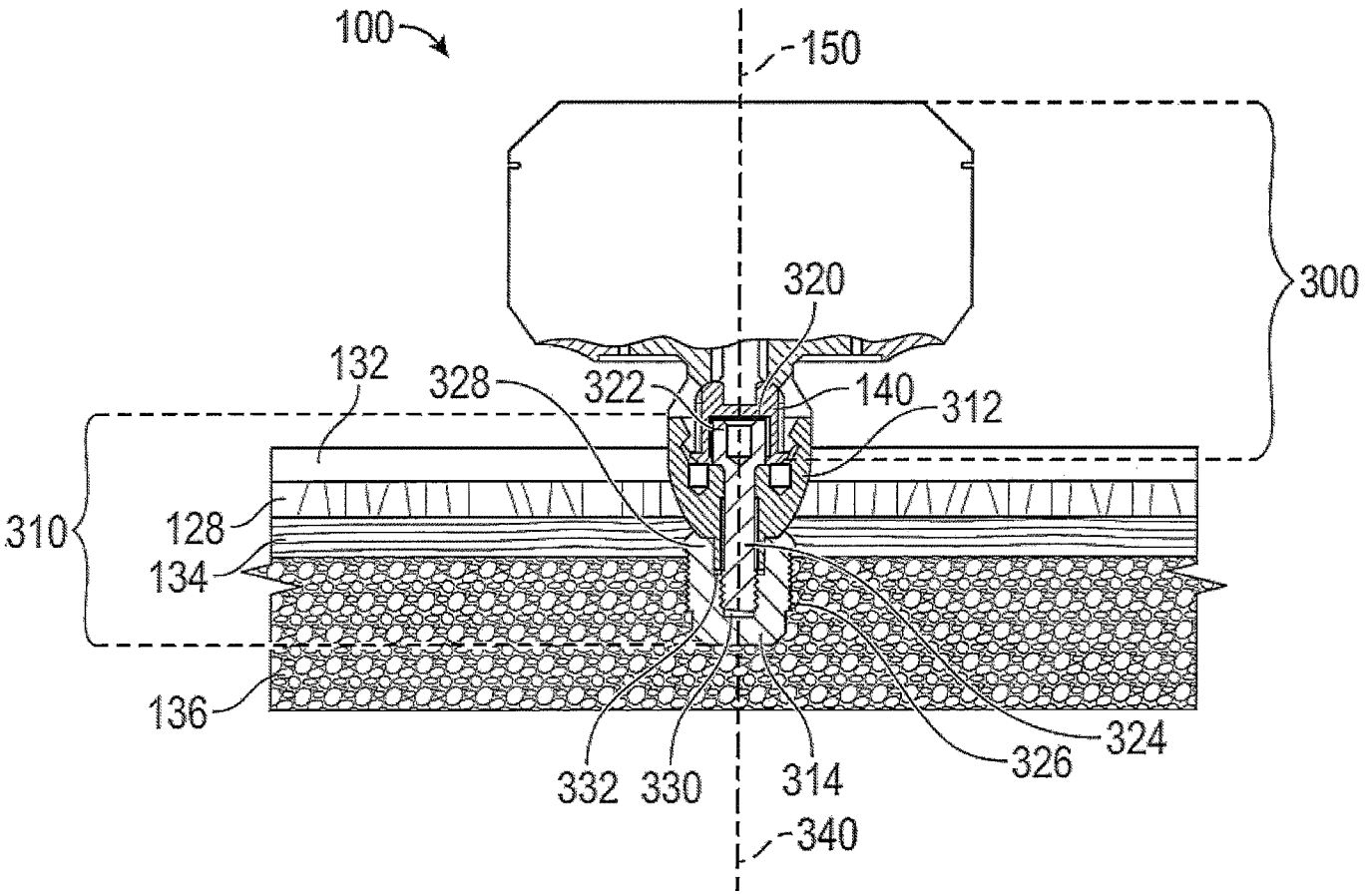
FIG. 1C depicts a side view of a portion of an example bone conduction implant in accordance with certain embodiments described herein.

FIG. 1A is a perspective view of an example percutaneous bone conduction auditory prosthesis 100 implanted in a recipient in accordance with certain embodiments described herein. FIG. 1B is a functional block diagram of an example auditory prosthesis 100 in accordance with certain embodiments described herein. FIG. 1C schematically illustrates a portion of an example bone conduction implant 310 in accordance with certain embodiments described herein configured to be coupled to an operationally removable component 300 of an auditory prosthesis 100.

As shown in FIG. 1A, the recipient has an outer ear 101, a middle ear 102, and an inner ear 103. Elements of the outer ear 101, the middle ear 102, and the inner ear 103 are described below, followed by a description of the auditory prosthesis 100. In a fully functional human hearing anatomy, the outer ear 101 comprises an auricle 105 and an ear canal 106. A sound wave or acoustic pressure 107 is collected by the auricle 105 and channeled into and through the ear canal 106. Disposed across the distal end of the ear canal 106 is a tympanic membrane 104 which vibrates in response to the acoustic wave 107. This vibration is coupled to the oval window or fenestra ovalis 110 through three bones of the middle ear 102, collectively referred to as the ossicles 111 and comprising the malleus 112, the incus 113, and the stapes 114. The ossicles 111 of the middle ear 102 serve to filter and amplify the acoustic wave 107, causing the oval window 110 to vibrate. Such vibrations set up waves of fluid motion within the cochlea 139. Such fluid motion, in turn, activates hair cells (not shown) that line the inside of the cochlea 139. Activation of the hair cells causes appropriate nerve impulses to be transferred through the spiral ganglion cells and the auditory nerve 116 to the brain (not shown), where they are perceived as sound.

FIG. 1A also illustrates an example positioning of the auditory prosthesis 100 relative to the outer ear 101, the middle ear 102, and the inner ear 103 of a recipient of the auditory prosthesis 100. As shown in FIG. 1A, the auditory prosthesis 100 is positioned behind the outer ear 101 of the recipient and comprises a sound input element 126 to receive sound signals. The sound input element 126 can comprise, for example, a microphone, telecoil, etc. and can be located, for example, on or in the auditory prosthesis 100, or on a cable extending from the auditory prosthesis 100.

In certain embodiments, the auditory prosthesis 100 comprises an operationally removable component 300 and a bone conduction implant 310, as schematically illustrated by FIG. 1C. The operationally removable component 300 is operationally releasably coupled to the bone conduction implant 310. By operationally releasably coupled, it is meant that it is releasable in such a manner that the recipient can relatively easily attach and remove the operationally removable component 300 during normal use of the auditory prosthesis 100, repeatedly if desired. Such releasable coupling is accomplished via a coupling apparatus of the operationally removable component 300 and a corresponding mating apparatus of the bone conduction implant 310, as will be detailed below. This operationally releasable coupling is contrasted with how the bone conduction implant 310 is attached to the skull, as will also be detailed below.

The operationally removable component 300 includes the sound input element 126, a sound processor (e.g.; an electronics module 204 as shown in FIG. 1B), and an actuator 206 (e.g., a transducer module, as shown in FIG. 1B) configured to generate acoustic vibrations. The actuator 206 can comprise a vibrator (e.g., a vibrating electromagnetic actuator; a vibrating piezoelectric actuator; other type of vibrating actuator), and the operationally removable component 300 is sometimes referred to herein as a vibrator unit. More particularly, the sound input element 126 (e.g., a microphone) converts received sound signals 107 into electrical signals 222. Alternatively, sound signals 107 are received by the sound input element 126 as electrical signals (e.g., via a cable or wireless connection, such as from an audiovisual device). The electrical signals 222 from the sound input element 126 are processed by the electronics module 204, which can include a sound processing circuit, control electronics, transducer drive components, and a variety of other elements.

The electronics module 204 is configured to respond to the electrical signals 222 by generating control signals 224 which cause the actuator 206 to vibrate, generating a mechanical output force in the form of acoustic vibrations that is delivered to the skull of the recipient via the bone conduction implant 310. In other words, the operationally removable component 300 converts the received sound signals 107 into mechanical motion using the actuator 206 to impart vibrations to the recipient's skull. Delivery of this output force causes motion or vibration of the recipient's skull, thereby activating the hair cells in the recipient's cochlea 139 via cochlea fluid motion.

As shown in FIG. 1B, the operationally removable component 300 can further comprise a power module 210 configured to provide electrical power to one or more components of the auditory prosthesis 100. For ease of illustration, the power module 210 has been shown connected only to user interface module 212 and the electronics module 204. However, it should be appreciated that the power module 210 can be used to supply power to any electrically powered circuits/components of the auditory prosthesis 100. The user interface module 212 is configured to allow the recipient to interact with the auditory prosthesis 100. For example, the user interface module 212 can allow the recipient to adjust the volume, alter the speech processing strategies, power on/off the device, etc. In the example of FIG. 1B, the user interface module 212 communicates with the electronics module 204 via the signal line 228. The auditory prosthesis 100 of certain embodiments further includes an external interface module 214 configured to connect the electronics module 204 to an external device, such as a fitting system. Using the external interface module 214, the operationally removable component 300 can obtain information from the auditory prosthesis 100 (e.g., the current parameters, data, alarms, etc.) and/or modify the parameters of the auditory prosthesis 100 used in processing received sounds and/or performing other functions.

In the example of FIG. 1B, the sound input element 126, the electronics module 204, the actuator 206 (e.g., transducer module), the power module 210, the user interface module 212, and the external interface module 214 have been shown as integrated in a single housing 225. However, it should be appreciated that in certain examples, one or more of the illustrated components can be housed in separate or different housings. For example, in some embodiments, the actuator 206 and the sound input element 126 are housed in separate housings to eliminate a potential pathway for feedback. The sound input element 126, the electronics module 204, the power module 210, the user interface module 212, and the external interface module 214 can be housed in a behind-the-ear (BTE) component that is suspended from the pima (e.g., by an ear hook). Similarly, it should also be appreciated that in certain such embodiments, direct connections between the various modules and devices are not necessary and that the components can communicate, for example, via wireless connections.

As schematically illustrated in FIG. 1A, the operationally removable component 300 of the auditory prosthesis 100 further includes a coupling apparatus 140 configured to operationally removably attach the operationally removable component 300 to a bone conduction implant 310 (also referred to as an anchor system and/or a fixation system) which is implanted in the recipient. In the example auditory prosthesis 100 of FIG. 1A, the coupling apparatus 140 has a longitudinal axis 150 and is coupled to the bone conduction implant 310 (not shown in FIG. 1A).

FIG. 1C depicts a side view of a portion of an example bone conduction implant 310 in accordance with certain embodiments described herein. The example bone conduction implant 310 of FIG. 1C comprises a percutaneous abutment 312, a bone fixture 314 (hereinafter sometimes referred to as the fixture 314), and an abutment screw 320. While FIG. 1C illustrates one example bone conduction implant 310 in accordance with certain embodiments described herein, other bone conduction implants 310 (e.g., comprising abutments 312, fixtures 314, and/or abutment screws 320 of any type, size/having any geometry) are also compatible with certain embodiments described herein.

The bone conduction implant 310 is configured to be repeatedly coupled to and decoupled from the coupling apparatus 140 of the operationally removable component 300, as shown in FIG. 1C. The coupling apparatus 140 comprises a longitudinal axis 150 (e.g., an axis along a length of the coupling apparatus 140; an axis about which the coupling apparatus 140 is at least partially symmetric). For example, the coupling apparatus 140 can be configured to be removably attached to the bone conduction implant 310 by pressing the coupling apparatus 140 against the abutment 312 in a direction along (e.g., substantially parallel to) the longitudinal axis 150 of the coupling apparatus 140 and/or along (e.g., substantially parallel to) the longitudinal axis 340 of the abutment 312. In certain such embodiments, the coupling apparatus 140 can be configured to be snap-coupled to the abutment 312. In certain embodiments, as depicted by FIG. 1C, the coupling apparatus 140 comprises a male component and the abutment 312 comprises a female component configured to mate with the male component of the coupling apparatus 140. In certain embodiments, this configuration can be reversed, with the coupling apparatus 140 comprises a female component and the abutment 312 comprises a male component configured to mate with the female component of the coupling apparatus 140.

The operationally removable component 300 comprises the actuator 206, with the operationally removable component 300 vibrationally connected to and removably coupled to the bone conduction implant 310 via the coupling apparatus 140. More particularly, the actuator 206 of the operationally removable component 300 is in vibrational communication with the coupling apparatus 140 such that vibrations generated by the actuator 206, in response to a sound captured by the sound input element 126, are transmitted to the coupling apparatus 140 and then to the bone conduction implant 310 in a manner that at least effectively evokes hearing percept. By "effectively evokes a hearing percept," it is meant that the vibrations are such that a typical human between 18 years old and 40 years old having a fully functioning cochlea receiving such vibrations, where the vibrations communicate speech, would be able to understand the speech communicated by those vibrations in a manner sufficient to carry on a conversation provided that those adult humans are fluent in the language forming the basis of the speech. In certain embodiments, the vibrational communication effectively evokes a hearing percept, if not a functionally utilitarian hearing percept.

The abutment 312 of certain embodiments is symmetrical with respect to at least those portions of the abutment 312 above the top portion of the fixture 314. For example, the exterior surfaces of the abutment 312 can form concentric outer profiles about a longitudinal axis 340 of the abutment 312 (e.g., an axis along a length of the abutment 312; an axis about which the abutment 312 is at least partially symmetric). As shown in FIG. 1C, the exterior surfaces of the abutment 312 establish diameters lying on planes normal to the longitudinal axis 340 that vary along the length of the longitudinal axis 340. For example, the abutment 312 can include outer diameters that progressively become larger with increased distance from the fixture 314. In certain other embodiments, the outer diameters can have other outer profiles.

In certain embodiments, the abutment 312 is configured for integration between the skin and the abutment 312. Integration between the skin and the abutment 312 can be considered to occur when the soft tissue of the skin 132 encapsulates the abutment 312 in fibrous tissue and does not readily dissociate itself from the abutment 312. This too inhibits the entrapment, and/or growth of microbes proximate the bone conduction implant 310. For example, the abutment 312 can have a surface having features which are configured to reduce certain adverse skin reactions. In certain embodiments, the abutment 312 is coated to reduce the shear modulus, which can also encourage skin integration with the abutment 213. For example, at least a portion of the abutment 312 can be coated with or otherwise contain a layer of hydroxyapatite that enhances the integration of skin with the abutment 312.

The abutment 312 is configured to be attached to the fixture 314 via the abutment screw 320, and the fixture 314 is configured to be fixed to (e.g., screwed into) the recipient's skull bone 136. The abutment 312 extends from the fixture 314, through muscle 134, fat 128, and skin 132 so that the coupling apparatus 140 can be attached thereto. The abutment screw 320 (e.g., comprising a screw head 322 and an elongate coupling shaft 324 connected to the screw head 322) connects and holds the abutment 312 to the fixture 314, thereby rigidly attaching the abutment 312 to the fixture 314. The rigid attachment is such that the abutment 312 is vibrationally connected to the fixture 314 such that at least some of the vibrational energy transmitted to the abutment 312 is transmitted to the fixture 314 in a sufficient manner to effectively evoke a hearing percept. The percutaneous abutment 312 provides an attachment location for the coupling apparatus 140 that facilitates efficient transmission of mechanical force.

The fixture 314 can be made of any material that has a known ability to integrate into surrounding bone tissue (e.g., comprising a material that exhibits acceptable osseointegration characteristics). In certain embodiments, the fixture 314 is formed from a single piece of material (e.g., titanium) and comprises outer screw threads 326 forming a male screw which is configured to be installed into the skull bone 136 and a flange 328 configured to function as a stop when the fixture 314 is implanted into the skull bone 136. The screw threads 326 have can have a maximum diameter of about 3.5 mm to about 5.0 mm, and the flange 328 can have a diameter which exceeds the maximum diameter of the screw threads 326 (e.g., by approximately 10%-20%). The flange 328 has a planar bottom surface for resting against the outer bone surface, when the fixture 314 has been screwed down into the skull bone 136. The flange 328 prevents the fixture 314 in general, and, in particular, screw threads 326, from potentially completely penetrating completely through the bone 136.

The body of the fixture 314 can have a length sufficient to securely anchor the fixture 314 to the skull bone 136 without penetrating entirely through the skull bone 136. The length of the body can therefore depend on the thickness of the skull bone 136 at the implantation site. For example, the fixture 314 can have a length, measured from the planar bottom surface of the flange 328 to the end of the distal region (e.g., the portion farthest from the flange 328), that is no greater than 5 mm or between about 3.0 mm to about 5.0 mm, which limits and/or prevents the possibility that the fixture 314 might go completely through the skull bond 136.

The interior of the fixture 314 further includes an inner lower bore 330 having female screw threads configured to mate with male screw threads of the elongate coupling shaft 324 to secure the abutment screw 320 and the abutment 312 to the fixture 314. The fixture 314 further includes an inner upper bore 332 that receives a bottom portion of the abutment 312. While FIG. 1C shows the coupling apparatus 140 directly engaging with (e.g., directly contacting) the abutment screw 320 (e.g., the screw head 322), in certain other embodiments, the coupling apparatus 140 engages with the abutment 312 without directly engaging with (e.g., without directly contacting) the abutment screw 320.

In certain embodiments, the bottom of the abutment 312 includes a fixture connection section extending below a reference plane extending across the top of the fixture 314 and that interfaces with the fixture 314. Upon sufficient tensioning of the abutment screw 320, the abutment 312 sufficiently elastically and/or plastically stresses the fixture 314, and/or visa-versa, so as to form a tight seal at the interface of surfaces of the abutment 312 and the fixture 314. Certain such embodiments can reduce (e.g., eliminate) the chances of micro-leakage of microbes into the gaps between the abutment 312, the fixture 314 and the abutment screw 320.

Figure 2B:
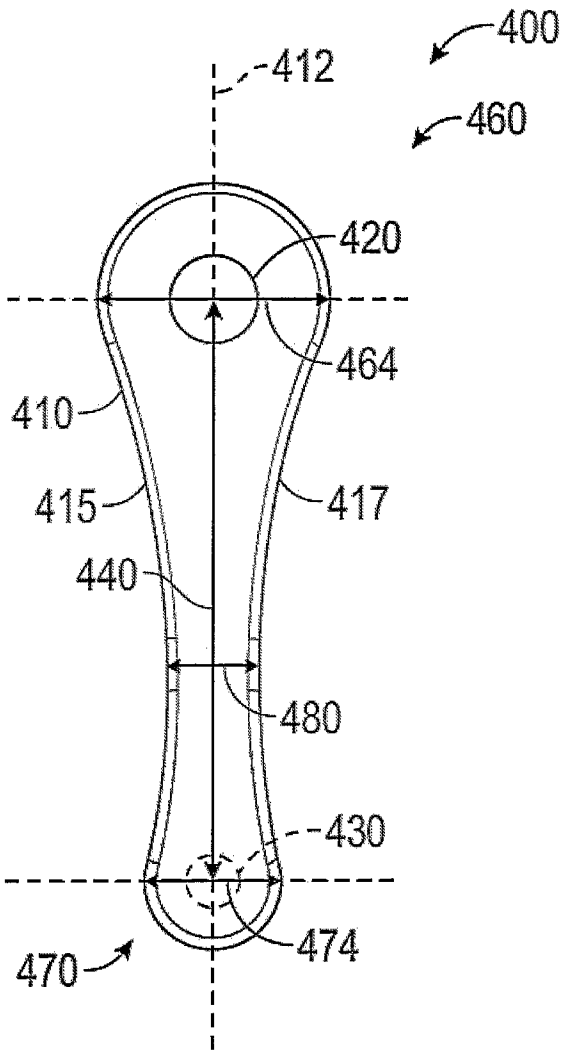
FIG. 2B schematically illustrates a bottom view of the example apparatus of FIG. 2A.
Figure 2A:
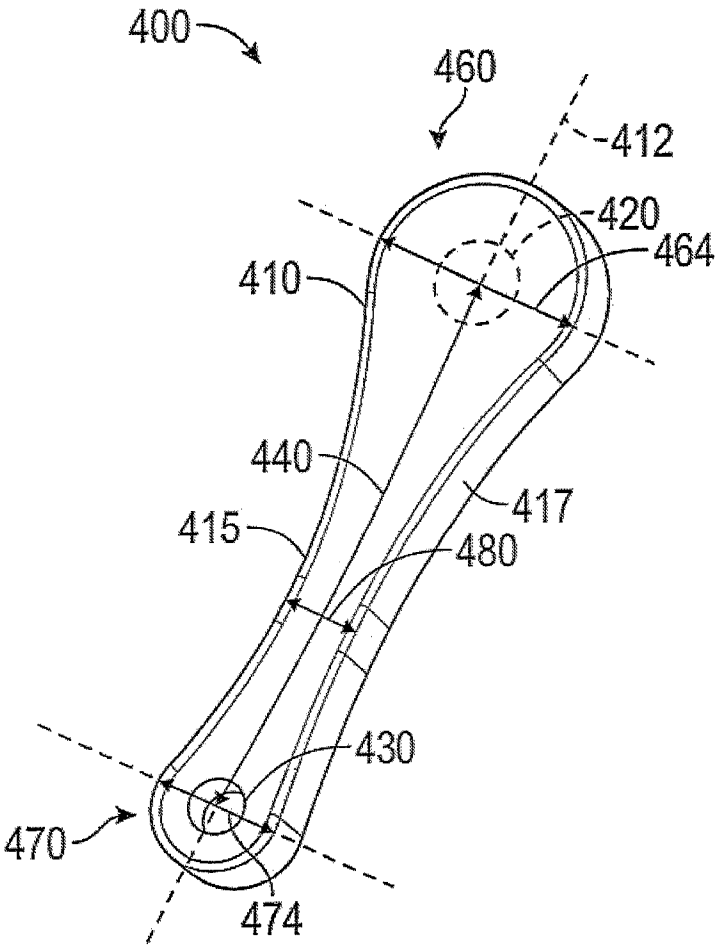
FIG. 2A schematically illustrates a top and side perspective view of an example apparatus in accordance with certain embodiments described herein.
Figure 2C:
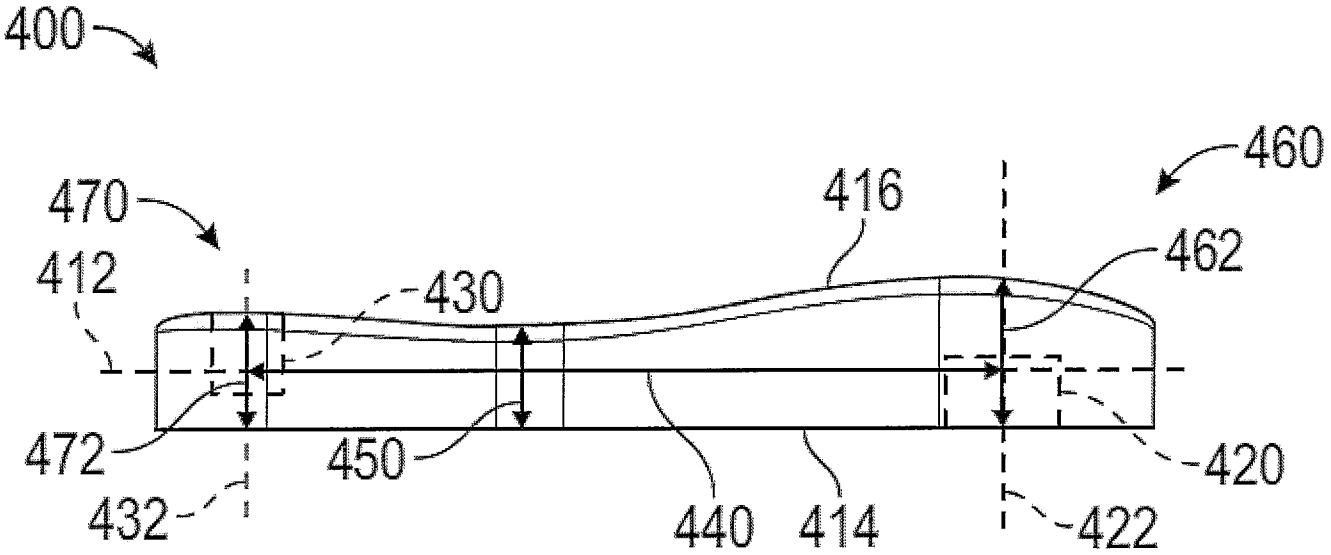
FIG. 2C schematically illustrates a side view of the example apparatus of FIG. 2A.

FIG. 2A schematically illustrates a top and side perspective view of an example apparatus 400 in accordance with certain embodiments described herein. FIG. 2B schematically illustrates a bottom view of the example apparatus 400 of FIG. 2A, and FIG. 2C schematically illustrates a side view of the example apparatus 400 of FIG. 2A. The apparatus 400 comprises an elongate body 410, a first connector 420, and a second connector 430. The first connector 420 has a first axis 422 and is configured to be repeatedly attached to and detached from a percutaneous implant 310 (e.g., the example bone conduction implant 310 of FIG. 1C) of a bone conduction acoustic prosthesis system. The second connector 430 has a second axis 432 and is configured to be repeatedly attached to and detached from a component 300 (e.g., the example operationally removable component 300 of FIG. 1C) of the acoustic prosthesis system, with the component external to the recipient. The first axis 422 and the second axis 432 are offset from one another along a first direction 440. FIGS. 2A-2C do not show detailed structures for the first connector 420 and the second connector 430, but example structures for the first connector 420 and the second connector 430 are described herein (see, e.g., FIG. 3). The offset between the first connector 420 and the second connector 430 displaces the component 300 along the first direction 440 relative to the implant 310. In certain embodiments, the apparatus 400 displaces the component 300 relative to the implant 310 so that the component 300 does not overlap the implant 310 (e.g., there is not a line perpendicular to the skin surface encircling the implant 310 that intersects both the component 300 and the implant 310).

In certain embodiments, the body 410 comprises one or more materials and has sufficiently mechanical rigidity to support the component 300 when the apparatus 400 is mechanically coupled to the implant 310 and the component 300. For example, the one or more materials can be selected from the group consisting of: metals (e.g., aluminum), metal matrix composites, polymers (e.g., polyether ether ketone ("PEEK"), polyoxymethylene ("POM"), polyphenylsulfone ("PPSU")), plastics, reinforced plastics, silicone, silicone-based materials, ceramics, ceramic matrix composites, fiberglass-containing materials, and resin-based materials. While the apparatus 400 is worn by the recipient (e.g., when the apparatus 400 is mechanically coupled to the implant 310), the body 410 can contact the recipient's skin, either continuously or intermittently. In certain such embodiments, the body 410 comprises a first material (e.g., metal) selected to provide a predetermined structural rigidity and a second material (e.g., silicone) covering (e.g., coating) the first material, the second material selected to provide a predetermined comfort level to the recipient when in contact with the recipient's skin.

The body 410 of certain embodiments comprises a longitudinal axis 412 along which the body 410 extends. For example, as schematically illustrated in FIGS. 2A and 2B, the body 410 can be substantially symmetric about the longitudinal axis 412. In certain embodiments, the longitudinal axis 412 is substantially parallel to the first direction 440. For example, as schematically illustrated in FIGS. 2A-2C, the longitudinal axis 412 coincides with the first direction 440.

The first axis 422 of the first connector 420 comprises an axis along a length of the first connector 420 or an axis about which the first connector 420 is at least partially symmetric (e.g., a center axis of the first connector 420). The second axis 432 of the second connector 430 comprises an axis along a length of the second connector 430 or an axis about which the second connector 430 is at least partially symmetric (e.g., a center axis of the second connector 430). In the example apparatus 400 of FIGS. 2A-2C, the first axis 422 of the first connector 420 is non-parallel (e.g., perpendicular) to the longitudinal axis 412 and the second axis 432 of the second connector 430 is non-parallel (e.g., perpendicular) to the longitudinal axis 412.

In certain embodiments, the apparatus 400 is configured (e.g., the first connector 420 is offset from the second connector 430) to displace the component 300 relative to the implant 310 and/or to substantially prevent the component 300 from overlapping the implant 310. In certain embodiments, the first axis 422 of the first connector 420 and the second axis 432 of the second connector 430 are offset from one another by a lateral distance (e.g., a distance along the longitudinal axis 412 of the body 410). For example, the first axis 422 can be spaced from the second axis 432 by a lateral distance in a range between 20 millimeters and 90 millimeters, a range between 25 millimeters and 80 millimeters, a range between 30 millimeters and 70 millimeters, a range between 35 millimeters and 60 millimeters, or a range between 40 millimeters and 50 millimeters. For another example, a center-to-center distance between the first connector 420 and the second connector 430 can be in a range between 20 millimeters and 90 millimeters, a range between 25 millimeters and 80 millimeters, a range between 30 millimeters and 70 millimeters, a range between 35 millimeters and 60 millimeters, or a range between 40 millimeters and 50 millimeters. In certain such embodiments, the first axis 422 of the first connector 420 and the second axis 432 of the second connector 430 are offset from one another such that the first axis 422 and the second axis 432 do not intersect one another (e.g., are parallel to one another; are non-planar with one another). In certain embodiments, the first connector 420 and the second connector 430 are positioned such that there is not a vertical line of sight (e.g., a line perpendicular to the longitudinal axis 412) that intersects both the first connector 420 and the second connector 430.

The first connector 420 of certain embodiments is configured to be removably attached to the implant 310 by pressing the first connector 420 against the abutment 312 in a direction along (e.g., substantially parallel to) the first axis 422 and/or along (e.g., substantially parallel to) the longitudinal axis 340 of the abutment 312. In certain such embodiments, the first connector 420 can be configured to be snap-coupled to the abutment 312 (e.g., the first connector 420 is spring-loaded and configured to be reversibly attached to the abutment 312). The second connector 430 of certain embodiments is configured to be removably attached to the coupling apparatus 140 of the component 300 by pressing the second connector 430 and the coupling apparatus 140 against one another in a direction along (e.g., substantially parallel to) the second axis 432 and/or along (e.g., substantially parallel to) the longitudinal axis 150 of the coupling apparatus 140. In certain such embodiments, the second connector 430 can be configured to be snap-coupled to the coupling apparatus 140 (e.g., the second connector 430 is spring-loaded and configured to be reversibly attached to the component 300).

Figure 3:
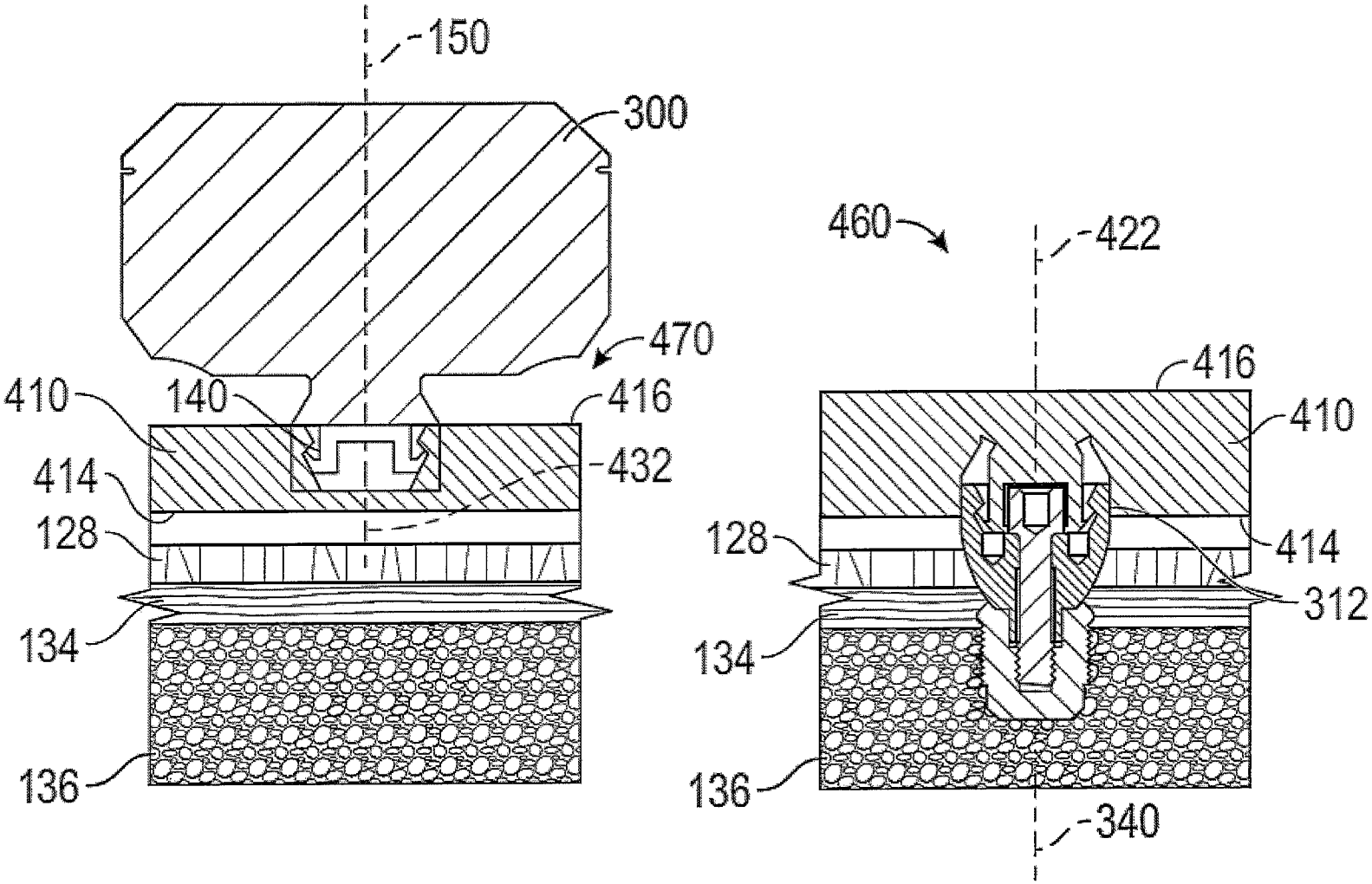
FIG. 3 schematically illustrates a cross sectional view (not to scale) of an example first connector and an example second connector in accordance with certain embodiments described herein.

The first connector 420 of certain embodiments has a structure configured to couple with the example abutment 312 shown in FIG. 1C and the second connector 430 of certain embodiments has a structure configured to couple with the example coupling apparatus 140 shown in FIG. 1C. FIG. 3 schematically illustrates a cross sectional view (not to scale) of an example first connector 420 and an example second connector 430 in accordance with certain embodiments described herein. The first connector 420 can be partially recessed or wholly recessed into the body 410 of the apparatus 400 (e.g., extending at least partially past a first outer surface 414 of the body 410 or not extending past the first outer surface 414). The second connector 430 can be partially recessed or wholly recessed into the body 410 of the apparatus 400 (e.g., extending at least partially past a second outer surface 416 of the body 410 or not extending past the second outer surface 416). In certain embodiments, the first connector 420 comprises a male component (e.g., a protrusion) configured to mate with a female component (e.g., a recess) of the abutment 312, and the second connector 430 comprises a female component (e.g., a recess) configured to mate with a male component (e.g., a protrusion) of the coupling apparatus 140 of the component 300. In certain embodiments, this configuration can be reversed, with the first connector 420 comprising a female component (e.g., a recess) configured to mate with a male component (e.g., a protrusion) of the abutment 312, and the second connector 430 comprising a male component (e.g., a protrusion) configured to mate with a female component (e.g., a recess) of the coupling apparatus 140.

As schematically illustrated in FIG. 2C, the body 410 of certain embodiments has a thickness in a second direction 450 that is substantially perpendicular to the first direction 440, with the thickness varying along the body 410 between the first connector 420 and the second connector 430. For example, the thickness can have a minimum thickness value (e.g., less than or equal to 5 millimeters) between the first connector 420 and the second connector 430. The position along the body 410 at which the thickness has the minimum thickness value can be closer to the second connector 430 than to the first connector 420, as schematically illustrated by FIG. 2C. For example, the distance of the minimum thickness value from the second connector 430 can be in a range of 10% to 40% of the offset distance (e.g., center-to-center distance) between the first connector 420 and the second connector 430.

In certain embodiments, the thickness is configured to provide structural rigidity to the body 410. For example, the first outer surface 414 and the second outer surface 416 of the body 410 can be spaced from one another by the thickness which varies as a function of position (e.g., is different at different positions between the first connector 420 and the second connector 430) along the body 410 (e.g., along the first direction 440; along the longitudinal axis 412). As schematically illustrated in FIG. 2C, the first outer surface 414 can be substantially flat and configured to face towards the skin of the recipient when the apparatus 400 is worn by the recipient (e.g., when the first connector 420 is mechanically coupled to the implant 310). The second outer surface 416 can be substantially curved and configured to face away from the skin of the recipient when the apparatus 400 is worn by the recipient.

In certain embodiments, the body 410 comprises a first end portion 460 in which the first connector 420 is positioned and a second end portion 470 spaced from the first end portion 460 and in which the second connector 430 is positioned. The first end portion 460 can have a first maximum thickness 462 in the second direction 450 (e.g., along the first axis 422) substantially perpendicular to the first direction 440, and the second end portion 470 can have a second maximum thickness 472 in the second direction 450 (e.g., along the second axis 432). As schematically illustrated by FIG. 2C, in certain embodiments, the second maximum thickness 472 is less than the first maximum thickness 462.

As schematically illustrated in FIGS. 2A and 2B, the body 410 of certain embodiments has a width in a third direction 480 that is substantially perpendicular to the first direction 440 and substantially perpendicular to the second direction 450, with the width varying along the body 410 between the first connector 420 and the second connector 430. For example, the width can have a minimum width value (e.g., less than or equal to 5 millimeters) between the first connector 420 and the second connector 430. The position along the body 410 at which the width has the minimum width value can be closer to the second connector 430 than to the first connector 420, as schematically illustrated by FIGS. 2A and 2B. For example, the distance of the minimum width value from the second connector 430 can be in a range of 10% to 40% of the offset distance (e.g., center-to-center distance) between the first connector 420 and the second connector 430. In certain embodiments, the minimum thickness value and the minimum width value are located at substantially the same position along the body 410 as one another (e.g., co-located with one another; spaced from one another by ±2%, ±5%, or ±10% of the offset distance between the first connector 420 and the second connector 430).

In certain embodiments, the width is configured to provide structural rigidity to the body 410. For example, a first side surface 415 and the second outer surface 417 of the body 410 can be spaced from one another by the width which varies as a function of position (e.g., is different at different positions between the first connector 420 and the second connector 430) along the body 410 (e.g., along the first direction 440; along the longitudinal axis 412). As schematically illustrated in FIGS. 2A and 2B, both the first side surface 415 and the second side surface 417 can be substantially curved (e.g., with the first side surface 415 and the second side surface 417 having a mirror symmetry to one another about a plane along the first direction 440 and substantially perpendicular to the third direction 480). In certain embodiments, the first end portion 460 has a first maximum width 464 in the third direction 480 substantially perpendicular to the first direction 440 and to the second direction 450, and the second end portion 470 has a second maximum width 474 in the third direction 480. As schematically illustrated by FIGS. 2A and 2B, in certain embodiments, the second maximum width 474 is less than the first maximum width 464. For example, the first maximum width 464 can bisect the first connector 420 and can be in a range between 40 millimeters and 80 millimeters, and the second maximum width 474 can bisect the second connector 430 and can be in a range between 20 millimeters and 40 millimeters.

Figure 4A:
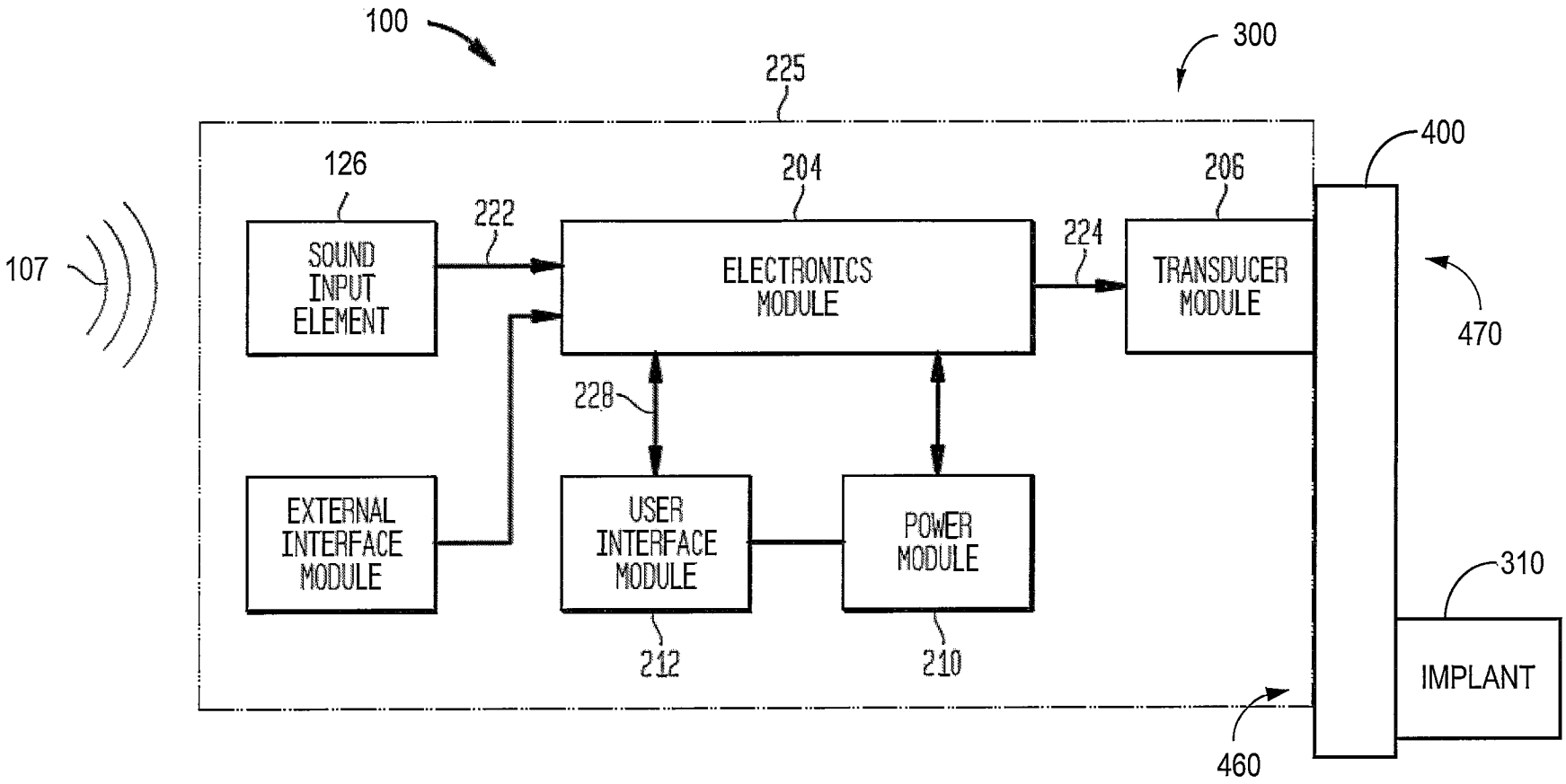
FIG. 4A is a functional block diagram of an example auditory prosthesis used with an extender in accordance with certain embodiments described herein.
Figure 4B:
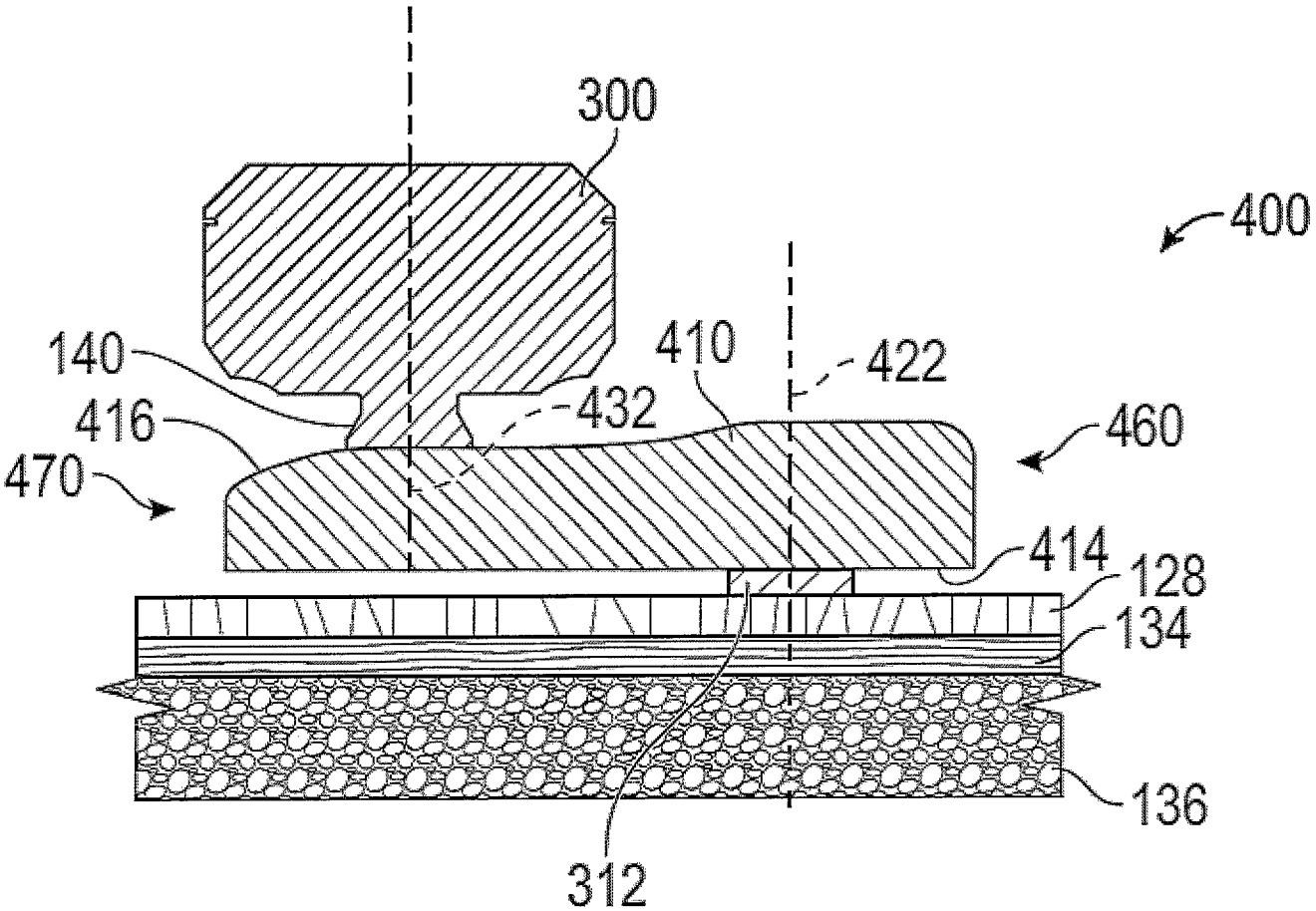
FIG. 4B schematically illustrates a side view (not to scale) of an example auditory prosthesis used with an extender in accordance with certain embodiments described herein.

The apparatus 400 is configured to be used as an extender when worn by the recipient along with the component 300. FIG. 4A is a functional block diagram of an example auditory prosthesis 100 used with an extender (e.g., apparatus 400) in accordance with certain embodiments described herein. FIG. 4B schematically illustrates a side view (not to scale) of an example auditory prosthesis 100 used with an extender (e.g., apparatus 400) in accordance with certain embodiments described herein. The extender is configured to be reversibly attached to an implant 310 (e.g., to an abutment 312 which is affixed to a fixture 314 implanted on a skull bone 136 of the recipient) of the auditory prosthesis 100. The extender is further configured to be reversibly attached to a component 300 (e.g., an actuator 206) of the auditory prosthesis 100, the component 300 external to the recipient. The extender is configured to transmit acoustic vibrations generated by the component 300 to the implant 310 (e.g., to the abutment 312) along a direction substantially parallel to the skull bone 136 proximal to the implant 310 (e.g., to the fixture 314). In certain embodiments, at least one of a thickness of the extender (e.g., a thickness of the body 410 of the apparatus 400) and a width of the extender (e.g., a width of the body 410 of the apparatus 400) are configured to vary along a length of the extender (e.g., a length of the body 410 of the apparatus 400) to provide structural rigidity to the extender (see, e.g., FIG. 2C).

The acoustic vibrations transmitted by the extender comprise acoustic vibrations in a range between 100 Hz and 10 kHz such that the recipient is able to perceive sounds and/or understand words spoken by another human that are received by the component 300 and communicated to the recipient via the acoustic vibrations transmitted by the extender. The extender of certain embodiments is configured to transmit the acoustic vibrations generated by the component 300 to the abutment 312 without substantially attenuating the acoustic vibrations in the range between 100 Hz and 10 kHz and/or without introducing vibrational resonances having frequencies in the range between 100 Hz and 10 kHz and having magnitudes that substantially degrade performance of the auditory prosthesis 100. For example, such performance can be achieved by configuring at least one of a thickness of the extender (e.g., a thickness of the body 410 of the apparatus 400) and a width of the extender (e.g., a width of the body 410 of the apparatus 400) to vary along a length of the extender (e.g., a length of the body 410 of the apparatus 400) (see, e.g., FIG. 2C).

The extender of certain embodiments is configured to ensure that a resonant frequency of the system comprising the extender (e.g., apparatus 400) and the component 300 is outside the audible range of the recipient (e.g., outside a range between 200 Hz and 20 kHz). For example, the combination of the apparatus 400 and the component 300 can be considered to be equivalent to a cantilever spring-mass system (e.g., assuming that the abutment side of the apparatus 400 is rigidly secured to the recipient's skull). The system can have a mass (e.g., approximated by the mass of the component 300) and a spring constant (e.g., a stiffness of the body 410), and the mass and/or the spring constant can be configured to provide a resonant frequency of the system that is outside the audible range of the recipient.

The extender of certain embodiments is shaped to avoid (e.g., reduce) resonances and/or distortions in the acoustic vibrations transmitted by the extender. For example, since sharp edges or discontinuities can promote internal reflections and/or standing waves that can interfere with sound quality, the extender can have sufficiently smoothly curved surfaces and/or sufficiently gradual (e.g., continuous) changes in thickness to avoid (e.g., reduce) such degradations of sound quality.

The extender of certain embodiments is fabricated from materials configured to avoid (e.g., reduce) vibrational damping (e.g., attenuation) and/or perceptible variation across the audible range of the recipient (e.g., across a range between 200 Hz and 20 kHz). For example, since high frequencies can be disproportionately attenuated by unintended damping, the one or more materials of the extender can be sufficiently dense and the connectors at either end of the extender can be sufficiently rigid to avoid (e.g., reduce) vibrational damping (e.g., attenuation) and/or avoid perceptible variation across the audible range of the recipient.

Figure 5A:
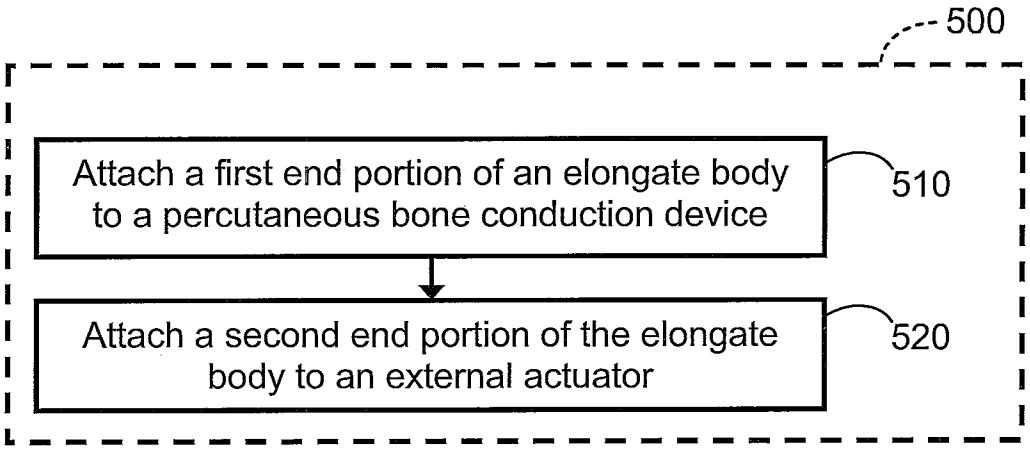
FIG. 5A is a flow diagram of an example method in accordance with certain embodiments described herein.

FIG. 5A is a flow diagram of an example method 500 in accordance with certain embodiments described herein. In an operational block 510, the method 500 comprises attaching a first end portion 460 of an elongate body 410 to a bone conduction device (e.g., implant 310) implanted on a recipient. The elongate body 410 extends in a first direction 440 along a portion of skin behind an outer ear of the recipient. The method 500 further comprises attaching a second end portion 470 of the elongate body 410 to an external actuator 206. The actuator 206 is offset from the bone conduction device along the first direction 440. The method 500 of certain embodiments further comprises transmitting acoustic vibrations generated by the actuator 206 along the elongate body 410 to the bone conduction device (e.g., implant 310).

The method 500 of certain embodiments further comprises placing a helmet 600 over the skull of the recipient such that the actuator 206 (e.g., component 300) and the helmet 300 are not in contact with one another. Placing the helmet 600 over the skull can comprise placing the helmet 600 to be in mechanical communication (e.g., in contact) with the first end portion 460 of the elongate body 410. For example, by having the first end portion 460 of the body 410 in contact with a portion of the helmet 600 (e.g., a soft portion) or in contact with the recipient's hair which is in contact with the portion of the helmet 600, the helmet 600 can advantageously provide additional structural stability to the apparatus 400 and/or can be advantageously used to dampen or reduce undesirable vibrations and/or resonances from reaching the implant 310.

Figure 5B:
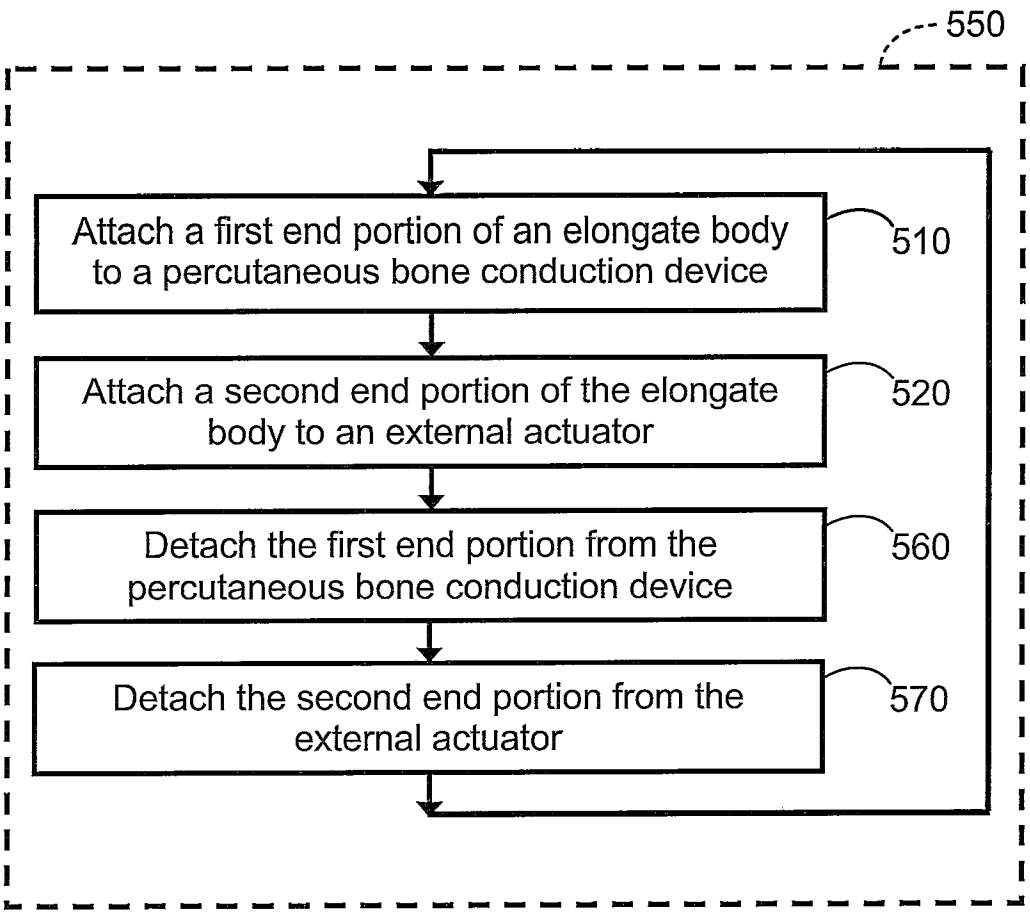
FIG. 5B is a flow diagram of another example method in accordance with certain embodiments described herein.

FIG. 5B is a flow diagram of another example method 550 in accordance with certain embodiments described herein. The method 550 comprises the operational blocks 510 and 520 described above with regard to the example method 500. In an operational block 560, the method 550 further comprises detaching the first end portion 460 from the bone conduction device (e.g., implant 310), and in an operational block 570, the method 550 further comprises detaching the second end portion 470 from the external actuator 206. The method 550 of certain embodiments further comprises attaching the actuator 206 to the bone conduction device and transmitting acoustic vibrations generated by the actuator 206 to the bone conduction device without the apparatus 400 (e.g., normal operation of the acoustic prosthesis when the helmet 600 is not being worn by the recipient). As shown in FIG. 5B, the apparatus 400 of certain embodiments can be repeatedly attached to and detached from both the bone conduction device and the actuator 206, as needed or desired, to position the actuator 206 away from the implant 310 so as to accommodate the helmet 600 being worn by the recipient.

Figure 6A:
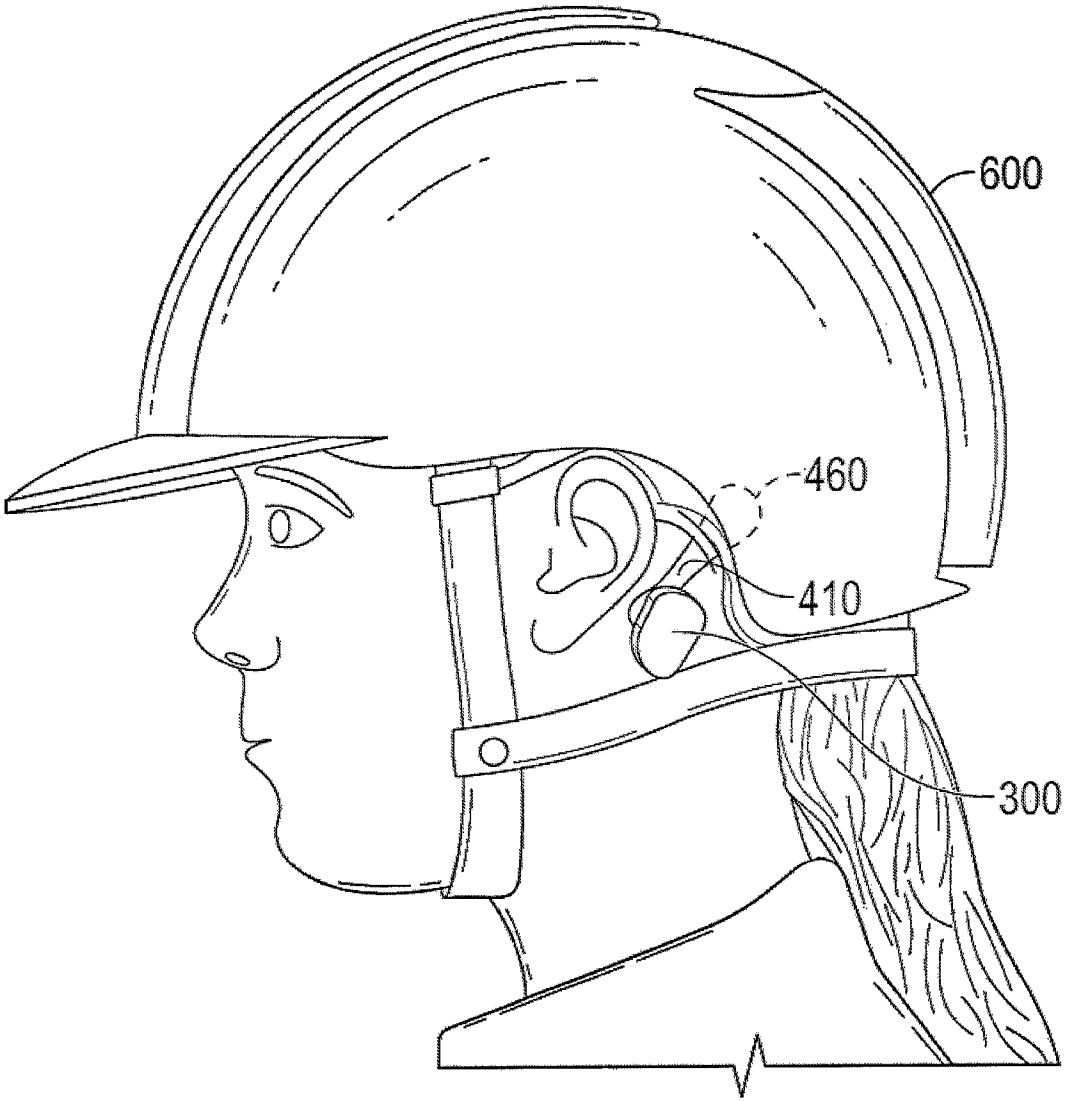
FIGS. 6A and 6B schematically illustrate two examples of the apparatus and the component being worn by a recipient in accordance with certain embodiments described herein.
Figure 6B:
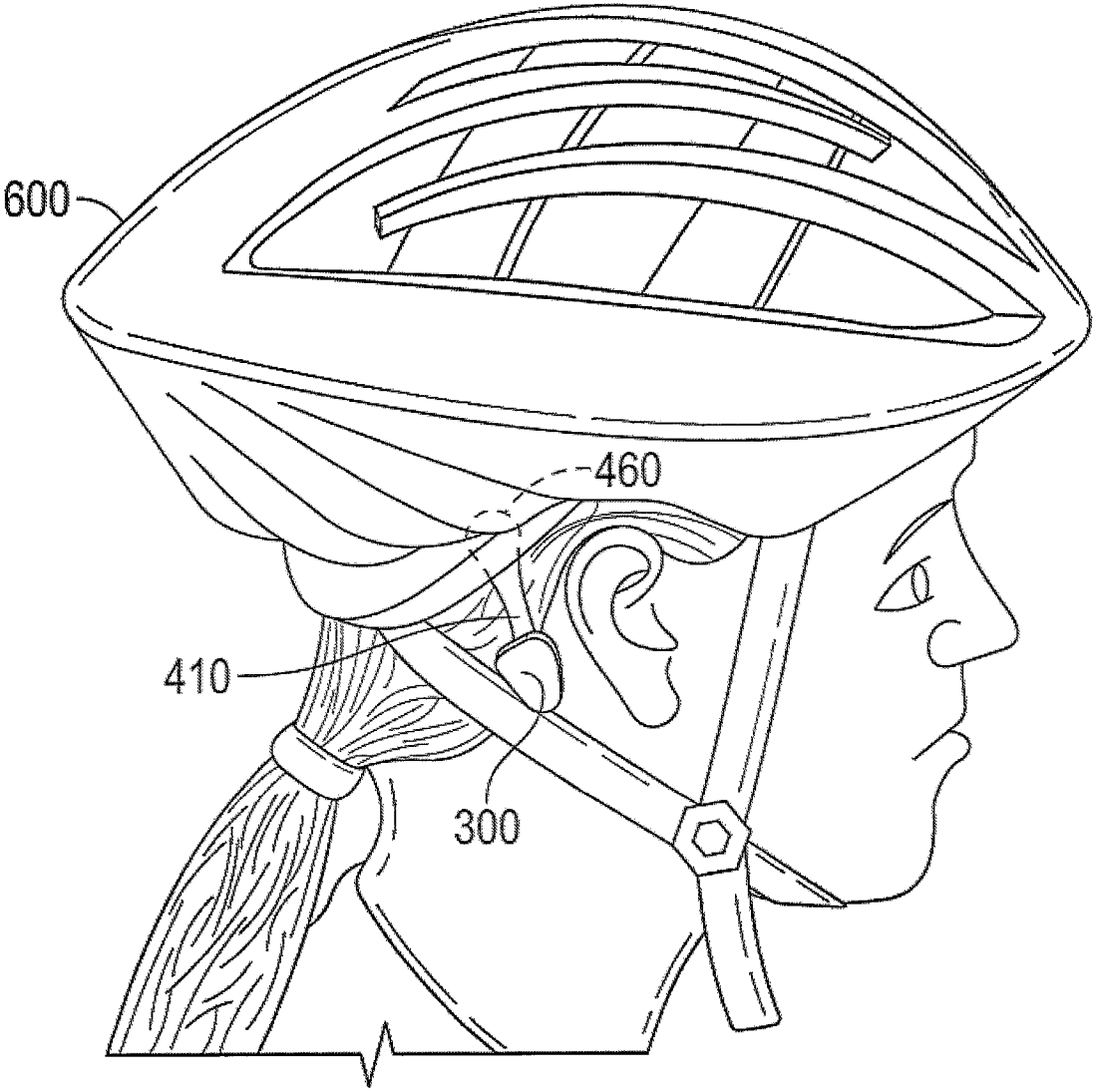

FIGS. 6A and 6B schematically illustrate two examples of the apparatus 400 and the component 300 being worn by a recipient in accordance with certain embodiments described herein. In both examples, the first end portion 460 of the body 410 is between the helmet and the implant 310. In FIG. 6A, a portion of the body 410 is under some of the recipient's hair while in FIG. 6B, a portion of the body 410 is above some of the recipient's hair. Because the helmet 600 covers and/or is in close proximity to the implant 310 when the helmet 600 is worn by the recipient, the component 300 does not fit onto the implant 310 in its standard position directly coupled to the implant 310 (see, e.g., FIG. 1C). In both examples of FIGS. 6A and 6B, the apparatus 400 advantageously offsets the position of the component 300 from its standard position to advantageously allow both the component 300 and the helmet 600 to be worn by the recipient. Thus, certain such embodiments advantageously allow the recipient to benefit from simultaneously wearing the helmet 600 for safety and using the auditory prosthesis 100 for hearing.

Various examples of the apparatus 400 in certain embodiments are described herein in conjunction with a percutaneous auditory prosthesis. In certain other embodiments, the apparatus 400 is configured to be used in conjunction with other types of auditory prostheses (e.g., a passive transcutaneous bone conduction device, an example of which is disclosed in U.S. Pat. No. 9,967,685). The passive transcutaneous bone conduction device can comprise a vibrating actuator located in an external component and configured to be electromagnetically coupled to an implanted plate assembly rigidly coupled to the recipient's skull. For example, the actuator and the implanted plate assembly can each comprise at least one ferromagnetic element, with the at least one ferromagnetic element of one of the actuator and the implanted plate assembly configured to generate a magnetic field (e.g., a permanent magnet) and the other at least one ferromagnetic element of the actuator and the implanted plate assembly configured to be reactive to the magnetic field. The vibrating actuator converts electrical signals received from a sound input element into vibrations of the at least one ferromagnetic element of the actuator, which are transferred transcutaneously from the vibrating actuator to the at least one ferromagnetic element of the implanted plate assembly. This can be accomplished as a result of mechanical conduction of the vibrations through the skin, resulting from the external component being in direct contact with the skin and/or from the magnetic field between the ferromagnetic elements of the vibrating actuator and the implanted plate assembly. These vibrations are transferred without penetrating the skin with a solid object such as an abutment, as detailed herein with respect to a percutaneous bone conduction device.

In certain embodiments, the apparatus 400 can comprise a first ferromagnetic element (e.g., a permanent magnet) configured to be mechanically coupled (e.g., snapped on; integral) to the first connector 420 and to be electromagnetically coupled to the implanted plate assembly, and/or a second ferromagnetic element (e.g., a permanent magnet) configured to be mechanically coupled (e.g., snapped on; integral) to the second connector 430 and to be electromagnetically coupled to the vibrating actuator. In certain such embodiments, the magnetic force between the first ferromagnetic element and the implantable plate assembly is sufficient to hold the apparatus 400 against the skin of the recipient, and/or the magnetic force between the second ferromagnetic element and the vibrating actuator is sufficient to hold the external component on the apparatus 400.

It is to be appreciated that the embodiments disclosed herein are not mutually exclusive and may be combined with one another in various arrangements.

The invention described and claimed herein is not to be limited in scope by the specific example embodiments herein disclosed, since these embodiments are intended as illustrations, and not limitations, of several aspects of the invention. Any equivalent embodiments are intended to be within the scope of this invention. Indeed, various modifications of the invention in form and detail, in addition to those shown and described herein, will become apparent to those skilled in the art from the foregoing description. Such modifications are also intended to fall within the scope of the claims. The breadth and scope of the invention should not be limited by any of the example embodiments disclosed herein, but should be defined only in accordance with the claims and their equivalents.

Certain Embodiments

Certain embodiments are listed below. The following embodiments are presented for explanatory and illustrative purposes only. It will be appreciated that the foregoing description is not limited to the following embodiments.

Embodiment 1: An apparatus comprising: an elongate body, a first connector, and a second connector, the first connector having a first axis and configured to be repeatedly attached to and detached from a percutaneous implant of a bone conduction acoustic prosthesis system, the second connector having a second axis and configured to be repeatedly attached to and detached from a component of the acoustic prosthesis system, the component external to the recipient, the first axis and the second axis offset from one another along a first direction.

Embodiment 2: The apparatus of Embodiment 1, wherein the component comprises an actuator configured to generate acoustic vibrations.

Embodiment 3: The apparatus of Embodiment 1 or Embodiment 2, wherein the body comprises a longitudinal axis substantially parallel to the first direction.

Embodiment 4: The apparatus of Embodiment 3, wherein the first axis is non-parallel to the longitudinal axis and the second axis is non-parallel to the longitudinal axis.

Embodiment 5: The apparatus of any of Embodiments 1 to 4, wherein the first axis and the second axis are offset from one another by a distance in a range between 30 millimeters and 70 millimeters.

Embodiment 6: The apparatus of any of Embodiments 1 to 5, wherein the first connector comprises a male connector and the second connector comprises a female connector, or the first connector comprises a female connector and the second connector comprises a male connector.

Embodiment 7: The apparatus of any of Embodiments 1 to 6, wherein the body has a thickness in a second direction substantially perpendicular to the first direction, the thickness varying along the body between the first connector and the second connector, the thickness configured to provide structural rigidity to the body.

Embodiment 8: The apparatus of Embodiment 7, wherein the thickness has a minimum thickness value between the first connector and the second connector, the minimum thickness value less than or equal to 5 millimeters.

Embodiment 9: The apparatus of any of Embodiments 1 to 8, wherein the body has a width in a third direction substantially perpendicular to the first direction and substantially perpendicular to the second direction, the width varying along the body between the first connector and the second connector, the width configured to provide structural rigidity to the body.

Embodiment 10: The apparatus of Embodiment 9, wherein the width has a minimum width value between the first connector and the second connector, the minimum width value less than or equal to 5 millimeters.

Embodiment 11: The apparatus of Embodiment 10, wherein the body has a thickness in a second direction substantially perpendicular to the first direction, the thickness varying along the body between the first connector and the second connector, the thickness has a minimum thickness value between the first connector and the second connector, wherein the minimum thickness value and the minimum width value are located at substantially the same position along the body as one another.

Embodiment 12: The apparatus of any of Embodiments 1 to 11, wherein the body comprises a first end portion in which the first connector is positioned and a second end portion spaced from the first end portion and in which the second connector is positioned.

Embodiment 13: The apparatus of Embodiment 12, wherein the first end portion has a first maximum thickness in a second direction substantially perpendicular to the first direction, and the second end portion has a second maximum thickness in the second direction, the second maximum thickness less than the first maximum thickness.

Embodiment 14: The apparatus of Embodiment 12 or Embodiment 13, wherein the first end portion has a first maximum width in a third direction substantially perpendicular to the first direction and substantially perpendicular to the second direction, the second end portion having a second maximum width along the third direction, the second maximum width less than the first maximum width.

Embodiment 15: An apparatus comprising: an extender configured to be reversibly attached to an abutment of a bone conduction auditory prosthesis, the abutment affixed to a fixture implanted on a skull bone of a recipient, the extender further configured to be reversibly attached to a component of the auditory prosthesis, the component external to the recipient, the extender configured to transmit acoustic vibrations generated by the component to the abutment along a direction substantially parallel to the skull bone proximal to the fixture.

Embodiment 16: The apparatus of Embodiment 15, wherein the acoustic vibrations are in a range between 100 Hz and 10 kHz.

Embodiment 17: The apparatus of Embodiment 16, wherein the extender is configured to transmit the acoustic vibrations generated by the component to the abutment without substantially attenuating the acoustic vibrations in the range.

Embodiment 18: The apparatus of Embodiment 16 or Embodiment 17, wherein the extender is configured to transmit the acoustic vibrations generated by the component to the abutment without introducing vibrational resonances having frequencies in the range and having magnitudes that substantially degrade performance of the auditory prosthesis.

Embodiment 19: The apparatus of any of Embodiments 15 to 18, wherein at least one of a thickness and a width of the extender are configured to vary along a length of the extender to provide structural rigidity to the extender.

Embodiment 20: The apparatus of any of Embodiments 15 to 19, wherein the extender comprises a spring-loaded first connector configured to be reversibly attached to the abutment.

Embodiment 21: The apparatus of any of Embodiments 15 to 20, wherein the extender comprises a spring-loaded second connector configured to be reversibly attached to the component.

Embodiment 22: A method comprising: attaching a first end portion of an elongate body to a bone conduction device implanted on a recipient, the elongate body extending in a first direction along a portion of skin behind an outer ear of the recipient; and attaching a second end portion of the elongate body to an external actuator, the actuator offset from the bone conduction device along the first direction.

Embodiment 23: The method of Embodiment 22, further comprises placing a helmet over the skull of the recipient such that the actuator and the helmet are not in contact with one another.

Embodiment 24: The method of Embodiment 23, wherein placing the helmet over the skull comprises placing the helmet to be in mechanical contact with the first end portion of the elongate body.

Embodiment 25: The method of any of Embodiments 22 to 24, further comprising transmitting acoustic vibrations generated by the actuator along the elongate body to the bone conduction device.

Embodiment 26: The method of any of Embodiments 22 to 25, further comprising detaching the first end portion from the bone conduction device, detaching the second end portion from the actuator, and attaching the actuator to the bone conduction device.

Embodiment 27: The method of any of Embodiments 22 to 26, wherein the bone conduction device is a percutaneous bone conduction device.

Embodiment 28: The method of, any of Embodiments 22 to 26, wherein the bone conduction device is a transcutaneous bone conduction device.

What is claimed is:

1. An apparatus comprising:

an elongate body having a longitudinal axis substantially along a first direction, a thickness in a second direction substantially perpendicular to the first direction, and a width in a third direction substantially perpendicular to the first direction and substantially perpendicular to the second direction, a first connector, and a second connector, the first connector having a first axis substantially parallel to the second direction and configured to be repeatedly and reversibly attached to a percutaneous implant of a bone conduction acoustic prosthesis system by being pressed against the percutaneous implant along the first axis, the second connector having a second axis non-parallel to the longitudinal axis and configured to be repeatedly and reversibly attached to a component of the acoustic prosthesis system by being pressed against the component along the second axis, the component external to the recipient, the body comprising a first end portion in which the first connector is positioned and a second end portion in which the second connector is positioned, the first end portion and the second end portion spaced from one another along the longitudinal axis, and the first axis and the second axis off set from one another along the first direction.

2. The apparatus of claim 1, wherein the component comprises an actuator configured to generate acoustic vibrations.

3. The apparatus of claim 1, wherein the first connector comprises a male connector and the second connector comprises a female connector, or the first connector comprises a female connector and the second connector comprises a male connector.

4. The apparatus of claim 1, wherein the thickness varies along the longitudinal axis between the first connector and the second connector, the thickness configured to provide structural rigidity to the body.

5. The apparatus of claim 4, wherein the thickness has a minimum thickness value between the first connector and the second connector, the minimum thickness value less than or equal to 5 millimeters.

6. The apparatus of claim 1, wherein the width varies along the longitudinal axis between the first connector and the second connector, the width configured to provide structural rigidity to the body.

7. The apparatus of claim 6, wherein the width has a minimum width value between the first connector and the second connector, the minimum width value less than or equal to 5 millimeters.

8. The apparatus of claim 1, wherein the first connector is configured to be reversibly attached to an abutment of the percutaneous implant, the abutment affixed to a fixture implanted on a skull bone of a recipient, the body configured to transmit acoustic vibrations generated by the component to the abutment along a direction substantially parallel to the skull bone proximal to the fixture.

9. The apparatus of claim 8, wherein the acoustic vibrations are in a range between 100 Hz and 10 kHz.

10. The apparatus of claim 9, wherein the body is configured to transmit the acoustic vibrations generated by the component to the abutment without substantially attenuating the acoustic vibrations in the range.

11. The apparatus of claim 9, wherein the body is configured to transmit the acoustic vibrations generated by the component to the abutment without introducing vibrational resonances having frequencies in the range and having magnitudes that substantially degrade performance of the acoustic prosthesis system.

12. The apparatus of claim 8, wherein at least one of the thickness and the width of the body are configured to vary along a length of the body to provide structural rigidity to the body.

13. The apparatus of claim 8, wherein the first connector comprises a spring-loaded first connector configured to be reversibly attached to the abutment.

14. The apparatus of claim 8, wherein the second connector comprises a spring-loaded second connector configured to be reversibly attached to the component.

15. An apparatus comprising:

an elongate body, a first connector, and a second connector, the first connector having a first axis and configured to be repeatedly attached to and detached from a percutaneous implant of a bone conduction acoustic prosthesis system, the second connector having a second axis and configured to be repeatedly attached to and detached from a component of the acoustic prosthesis system, the component external to the recipient, the first axis and the second axis offset from one another along a first direction, wherein the first axis and the second axis are offset from one another by a distance in a range between 30 millimeters and 70 millimeters.

16. The apparatus of claim 15, wherein the first connector comprises a male connector and the second connector comprises a female connector, or the first connector comprises a female connector and the second connector comprises a male connector.

17. The apparatus of claim 15, wherein the body has a thickness in a second direction substantially perpendicular to the first direction, the thickness varying along the body between the first connector and the second connector.

18. The apparatus of claim 15, wherein the body has a width in a third direction substantially perpendicular to the first direction and substantially perpendicular to the second direction, the width varying along the body between the first connector and the second connector.

19. An apparatus comprising:

an elongate body having a longitudinal axis substantially along a first direction, a thickness in a second direction substantially perpendicular to the first direction, and a width in a third direction substantially perpendicular to the first direction and substantially perpendicular to the second direction, a first connector, and a second connector, the first connector having a first axis substantially parallel to the second direction and configured to be repeatedly and reversibly attached to a percutaneous implant of a bone conduction acoustic prosthesis system by being pressed against the percutaneous implant along the first axis, the second connector having a second axis non-parallel to the longitudinal axis and configured to be repeatedly and reversibly attached to a component of the acoustic prosthesis system by being pressed against the component along the second axis, the component external to a recipient, the first axis and the second axis off set from one another along the first direction, wherein the width varies along the longitudinal axis between the first connector and the second connector, the width configured to provide structural rigidity to the body, the width has a minimum width value between the first connector and the second connector, the minimum width value less than or equal to 5 millimeters, the thickness varies along the body between the first connector and the second connector, the thickness has a minimum thickness value between the first connector and the second connector, wherein the minimum thickness value and the minimum width value located at substantially the same position along the body as one another.

20. An apparatus comprising:

an elongate body, a first connector, and a second connector, the body comprising a first end portion in which the first connector is positioned and a second end portion spaced from the first end portion and in which the second connector is positioned, the first connector having a first axis and configured to be repeatedly attached to and detached from a percutaneous implant of a bone conduction acoustic prosthesis system, the second connector having a second axis and configured to be repeatedly attached to and detached from a component of the acoustic prosthesis system, the component external to the recipient, the first axis and the second axis offset from one another along a first direction, wherein the first end portion has a first maximum thickness in a second direction substantially perpendicular to the first direction, and the second end portion has a second maximum thickness in the second direction, the second maximum thickness less than the first maximum thickness.

21. The apparatus of claim 20, wherein the body comprises a longitudinal axis substantially parallel to the first direction, the first axis is non-parallel to the longitudinal axis, and the second axis is non-parallel to the longitudinal axis.

22. The apparatus of claim 20, wherein the first axis and the second axis are offset from one another by a distance in a range between 30 millimeters and 70 millimeters.

23. The apparatus of claim 20, wherein the first end portion has a first maximum width in a third direction substantially perpendicular to the first direction and substantially perpendicular to the second direction, the second end portion having a second maximum width along the third direction, the second maximum width less than the first maximum width.

24. An apparatus comprising:

an elongate body, a first connector, and a second connector, the body comprising a first end portion in which the first connector is positioned and a second end portion spaced from the first end portion and in which the second connector is positioned, the first connector having a first axis and configured to be repeatedly attached to and detached from a percutaneous implant of a bone conduction acoustic prosthesis system, the second connector having a second axis and configured to be repeatedly attached to and detached from a component of the acoustic prosthesis system, the component external to the recipient, the first axis and the second axis offset from one another along a first direction, wherein the first end portion has a first maximum width in a third direction substantially perpendicular to the first direction and substantially perpendicular to a second direction substantially perpendicular to the first direction, the second end portion having a second maximum width along the third direction, the second maximum width less than the first maximum width.

25. The apparatus of claim 24, wherein the first connector comprises a male connector and the second connector comprises a female connector, or the first connector comprises a female connector and the second connector comprises a male connector.

26. The apparatus of claim 24, wherein the body has a thickness in the second direction and a width in the third direction, the thickness and the width varying along the body between the first connector and the second connector.

27. The apparatus of claim 26, wherein the width has a minimum width value between the first connector and the second connector and the thickness has a minimum thickness value between the first connector and the second connector, wherein the minimum width value and the minimum thickness value are located at substantially the same position along the body as one another.

* * * * *